US009915103B2

(12) United States Patent
Mueller et al.

(10) Patent No.: US 9,915,103 B2
(45) **Date of Patent: *Mar. 13, 2018**

(54) TRANSMISSION LINE FOR WIRED PIPE

(71) Applicants: Stephan Mueller, Lower Saxony (DE); Volker Peters, Wienhausen (DE); Ingo Roders, Seelze (DE); Robert Buda, Lower Saxony (DE); Rene Schulz, Saxony (DE); Henning Rahn, Niedersachsen (DE)

(72) Inventors: Stephan Mueller, Lower Saxony (DE); Volker Peters, Wienhausen (DE); Ingo Roders, Seelze (DE); Robert Buda, Lower Saxony (DE); Rene Schulz, Saxony (DE); Henning Rahn, Niedersachsen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 751 days.

This patent is subject to a terminal disclaimer.

(21) Appl. No.: 13/904,297

(22) Filed: May 29, 2013

(65) Prior Publication Data

US 2014/0352941 A1 Dec. 4, 2014

(51) Int. Cl.
*E21B 17/00* (2006.01)
*E21B 17/02* (2006.01)

(52) U.S. Cl.
CPC ..... *E21B 17/003* (2013.01); *E21B 17/023* (2013.01); *E21B 17/028* (2013.01)

(58) Field of Classification Search
CPC .... E21B 17/003; E21B 17/023; E21B 17/028; H01R 43/00
See application file for complete search history.

(56) References Cited

U.S. PATENT DOCUMENTS 3,518,608 A * 6/1970 Papadopoulos ..... E21B 17/00 175/104
5,086,196 A 2/1992 Brookbank et al.
(Continued)

FOREIGN PATENT DOCUMENTS

EP 1094194 A2 4/2001

OTHER PUBLICATIONS

Notification of Transmittal of the International Preliminary Report on Patentability and the Written Opinion of the International Searching Authority, or the Declaration; PCT/US2013/071182; dated Jun. 11, 2015, 10 pages.
(Continued)

*Primary Examiner* — Robert E Fuller
*Assistant Examiner* — Christopher J Sebesta
(74) *Attorney, Agent, or Firm* — Cantor Colburn LLP

(57) ABSTRACT

A wired pipe system includes a wired pipe segment having a first end and a second end, a first coupler in the first end and a second coupler in the second end and a transmission line disposed in the wired pipe segment between the first and second ends. The transmission line includes a transmission cable that includes an inner conductor and an insulating material disposed about the inner conductor as well as a a wire channel surrounding the insulating material and the inner conductor for at least a portion of a length of the transmission cable. The wire channel and the insulating material are mated together by at least one mating feature.

13 Claims, 7 Drawing Sheets

(56) References Cited

U.S. PATENT DOCUMENTS

| | | | | |
|---|---|---|---|---|
| 5,122,209 | A | 6/1992 | Moore et al. | |
| 5,745,047 | A | 4/1998 | Van Gisbergen et al. | |
| 5,894,104 | A | 4/1999 | Hedberg | |
| 6,982,384 | B2 | 1/2006 | Hall et al. | |
| 7,190,280 | B2 | 3/2007 | Hall et al. | |
| 7,224,289 | B2 | 5/2007 | Bausov et al. | |
| 2002/0193004 | A1* | 12/2002 | Boyle | E21B 17/028 439/577 |
| 2004/0079737 | A1 | 4/2004 | Pinchasik | |
| 2004/0149471 | A1 | 8/2004 | Hall et al. | |
| 2004/0150532 | A1 | 8/2004 | Hall et al. | |
| 2004/0177956 | A1 | 9/2004 | Boyadjielf | |
| 2005/0118848 | A1* | 6/2005 | Hall | E21B 17/003 439/194 |
| 2005/0145406 | A1 | 7/2005 | Hall et al. | |
| 2006/0021799 | A1 | 2/2006 | Hall et al. | |
| 2007/0169929 | A1 | 7/2007 | Hall et al. | |
| 2008/0106433 | A1 | 8/2008 | Madhavan et al. | |
| 2010/0108382 | A1 | 5/2010 | Ma et al. | |
| 2010/0111592 | A1* | 5/2010 | Hassell | E21B 17/023 403/24 |
| 2011/0108267 | A1* | 5/2011 | Chaize | E21B 17/023 166/242.6 |
| 2011/0240372 | A1* | 10/2011 | Davis | B23K 20/122 175/263 |
| 2011/0308807 | A1 | 12/2011 | Spencer | |
| 2012/0211235 | A1 | 8/2012 | Smith | |
| 2014/0102806 | A1* | 4/2014 | Millet | E21B 17/003 175/315 |

OTHER PUBLICATIONS

Notification of Transmittal of the International Search Report and the Written Opinion of the International Searching Authority, or the Declaration; PCT/US2014/039890; dated Sep. 29, 2014, 12 pages.

Notification of Transmittal of the International Search Report and the Written Opinion of the International Searching Authority; PCT/US2014/04450; dated Oct. 27, 2014; 18 pages.

Shah, et al. "Design Considerations for a New High Data Rate LWD Acoustic Telemetry System" SPE 88636. SPE Asia Pacific Oil and Gas Conference and Exhibition held in Perth, Australia, Oct. 18-20, 2004. 7 pages.

* cited by examiner

TRANSMISSION LINE FOR WIRED PIPE

BACKGROUND

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various coupling mechanisms, such as threaded couplings.

Pipe segments can be connected with tool joints that include a threaded male-female configuration often referred to as a pin-box connection. The pin-box connection includes a male member, i.e., a "pin end" that includes an exterior threaded portion, and a female member, i.e., a "box end", that includes an interior threaded portion and is configured to receive the pin end in a threaded connection Various power and/or communication signals may be transmitted through the pipe segments via a "wired pipe" configuration. Such configurations include electrical, optical or other conductors extending along the length of selected pipe segments. The conductors are operably connected between pipe segments by a variety of coupling configurations.

Some wired pipe configurations include a transmission device mounted on the tip of the pin end as well as in the box end. The transmission device, or "coupler," can transmit power, data or both to an adjacent coupler. The coupler in the pin end might be connected via a transmission line to the coupler in the box end.

BRIEF DESCRIPTION

Disclosed herein is wired pipe system that includes a wired pipe segment having a first end and a second end; a first coupler in the first end and a second coupler in the second end; and a transmission line disposed in the wired pipe segment between the first and second ends. The transmission line includes a transmission cable that includes an inner conductor and an insulating material disposed about the inner conductor. The transmission line also includes a wire channel surrounding the insulating material and the inner conductor for at least a portion of a length of the transmission cable. The wire channel and the insulating material are mated by means of at least one mating feature.

Also disclosed herein is a method of forming a wired pipe transmission line comprising: providing an assembly that includes insulating material disposed about an inner conductor; surrounding the insulating material with a shield layer to form a transmission cable; forming mating features in the shield layer; disposing the transmission cable within a wire channel; disposing a fixation element between the shield layer and the wire channel; and fixedly attaching the fixation element to the wire channel.

Further disclosed is a wired pipe transmission line for transmitting electrical signals in a wired pipe system, the wired pipe transmission line includes a transmission cable including: an inner conductor; an insulating material disposed about the inner conductor; and a shield layer surrounding the insulating material having shield layer mating features disposed on an outer surface thereof. The transmission line also includes a wire channel surrounding the insulating material and the inner conductor for at least a portion of a length of the transmission cable and a fixation element disposed between the shield layer and the wire channel that is fixedly attached to the wire channel, the fixation element including fixation element mating features formed on an inner portion that mate with shield layer mating features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

As described above, the couplers in a wired pipe system are electrically connected via a transmission cable. Embodiments herein are directed to transmission cable that can be used in a wired pipe system and examples of how such transmissions cables may be formed. In one or more of the embodiments disclosed herein, the transmission cable is capable of withstanding one or more loads, as tension, compression and torsion and superimposed dynamic accelerations typically present in downhole tools during drilling. In one embodiment, the transmission line consists of a wire channel and a transmission cable (one of coaxial cable, twisted pair wires, individual wires, for example) enclosed in the wire channel. While various manners of producing the wire channel are disclosed herein, any or all of them are formed such that the transmission cable can be held in a fixed position relative to the wire channel. In one embodiment, a fixation element interfaces with the transmission cable and is welded into fixed contact with the wire channel. In another embodiment, rather than a weld, the fixation element may be glued or otherwise affixed (e.g., by the use of microspheres) to the wire channel. In yet another embodiment, the fixation element can be omitted and the transmission cable itself is fixedly attached to the wire channel by any of adhesive or microsphere methods disclosed herein.

Figure 1:
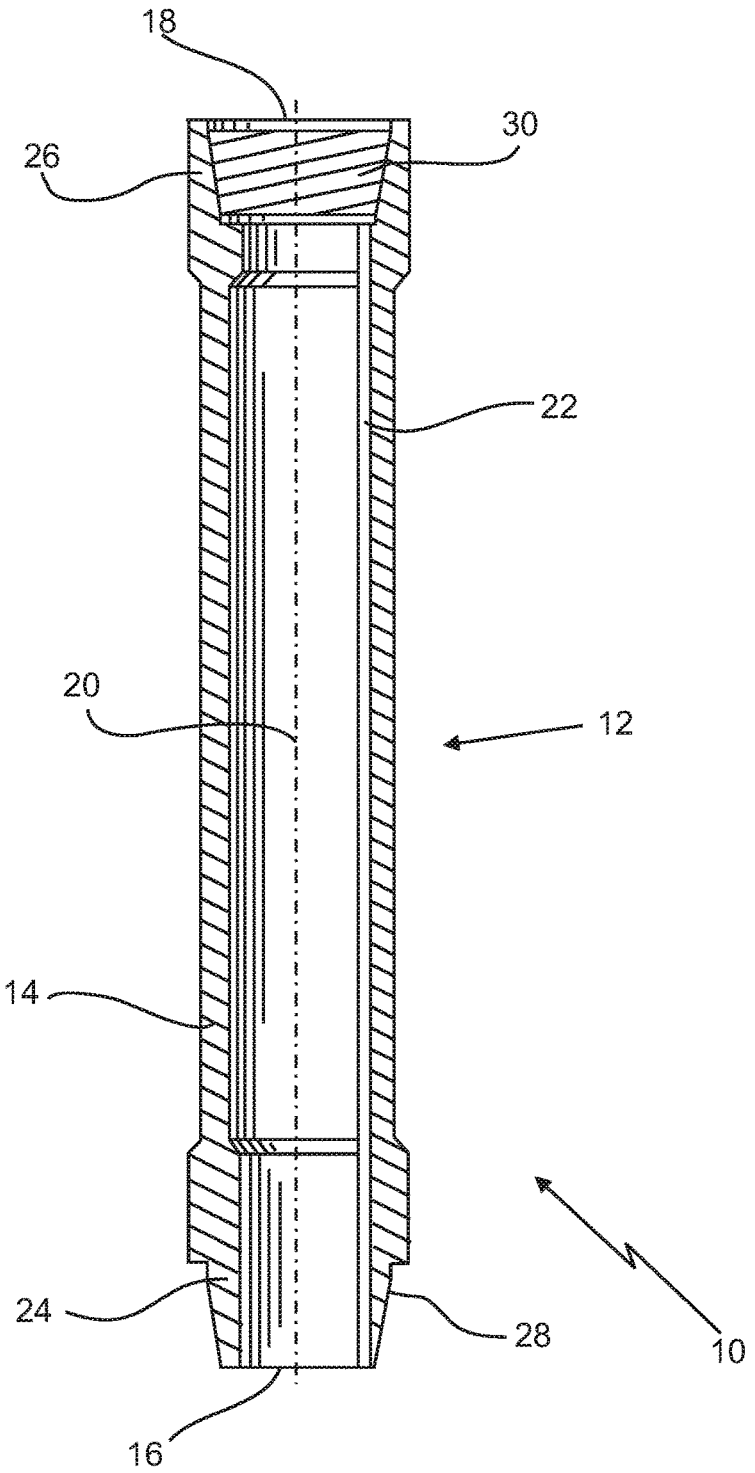
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole, or facilitating gas or liquid production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through an opening in a drill bit located at the downhole end of the string 12. The drilling fluid circulates uphole between the string 12 and the borehole wall and is discharged into the mud tank or other location.

The string 12 may include at least one wired pipe segment 14 having an uphole end 18 and a downhole end 16. As described herein, "uphole" refers to a location near the point where the drilling started relative to a reference location when the segment 14 is disposed in a borehole, and "downhole" refers to a location away from the point where the drilling started along the borehole relative to the reference location. It shall be understood that the uphole end 18 could be below the downhole end 16 without departing from the scope of the disclosure herein.

At least an inner bore or other conduit 20 extends along the length of each segment 14 to allow drilling mud or other fluids to flow there through. At least one transmission line 22 is located within the wired segment 14 to provide protection for electrical, optical or other conductors which can be part of the transmission line to be disposed along the wired segment 14. In one embodiment, the transmission line 22 includes a coaxial cable. In another embodiment, the transmission line 22 includes any manner of carrying power or data, including, for example, a twisted pair. In the case where the transmission line 22 includes a coaxial cable it may include an inner conductor surrounded by a dielectric material. The coaxial cable may also include a shield layer that surrounds the dielectric. The transmission line 22, as described further below, may include a wire channel that may be formed, for example, by a rigid or semi-rigid tube of a conductive or non-conductive material The segment 14 includes a downhole connection 24 and an uphole connection 26. The segment 14 is configured so that the uphole connection 26 is positioned at an uphole location relative to the downhole connection 24. The downhole connection 24 includes a male connection portion 28 having an exterior threaded section, and is referred to herein as a "pin end" 24. The uphole connection 26 includes a female connection portion 30 having an interior threaded section, and is referred to herein as a "box end" 26.

The pin end 24 and the box end 26 are configured so that the pin end 24 of one wired pipe segment 14 can be disposed within the box end 26 of another wired pipe segment 14 to affect a fixed connection there between to connect the segment 14 with another adjacent segment 14 or other downhole component. It shall be understood that a wired pipe segment may consist of several (e.g. three) segments. In one embodiment, the exterior of the male coupling portion 28 and the interior of the female coupling portion 30 are tapered. Although the pin end 24 and the box end 26 are described as having threaded portions, the pin end 24 and the box end 26 may be configured to be connected using any suitable mechanism, such as bolts or screws or an interference fit.

In one embodiment, the system 10 is operably connected to a downhole or surface processing unit which may act to control various components of the system 10, such as drilling, logging and production components or subs. Other components include machinery to raise or lower segments 14 and operably couple segments 14, and transmission devices. The downhole or surface processing unit may also collect and process data generated or transmitted by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's (Bottom Hole Assembly) and drill strings.

Figure 2:
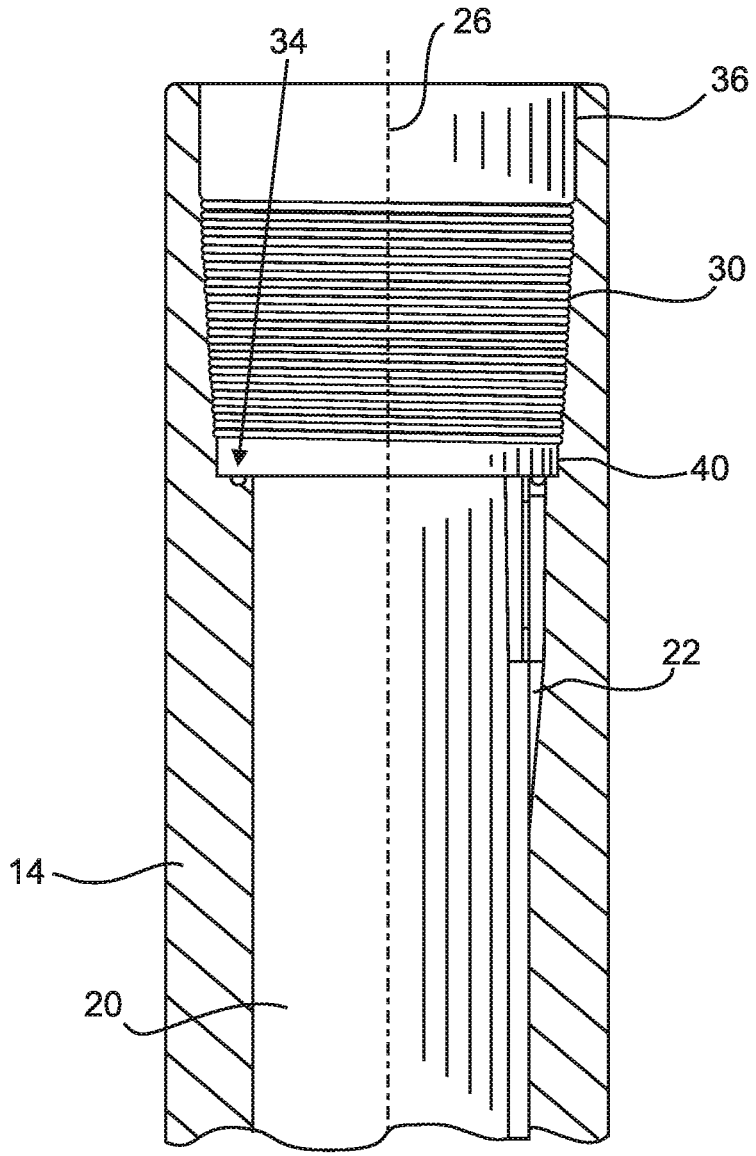
FIG. 2 depicts an exemplary embodiment of a box end of the segment of FIG. 1.
Figure 3:
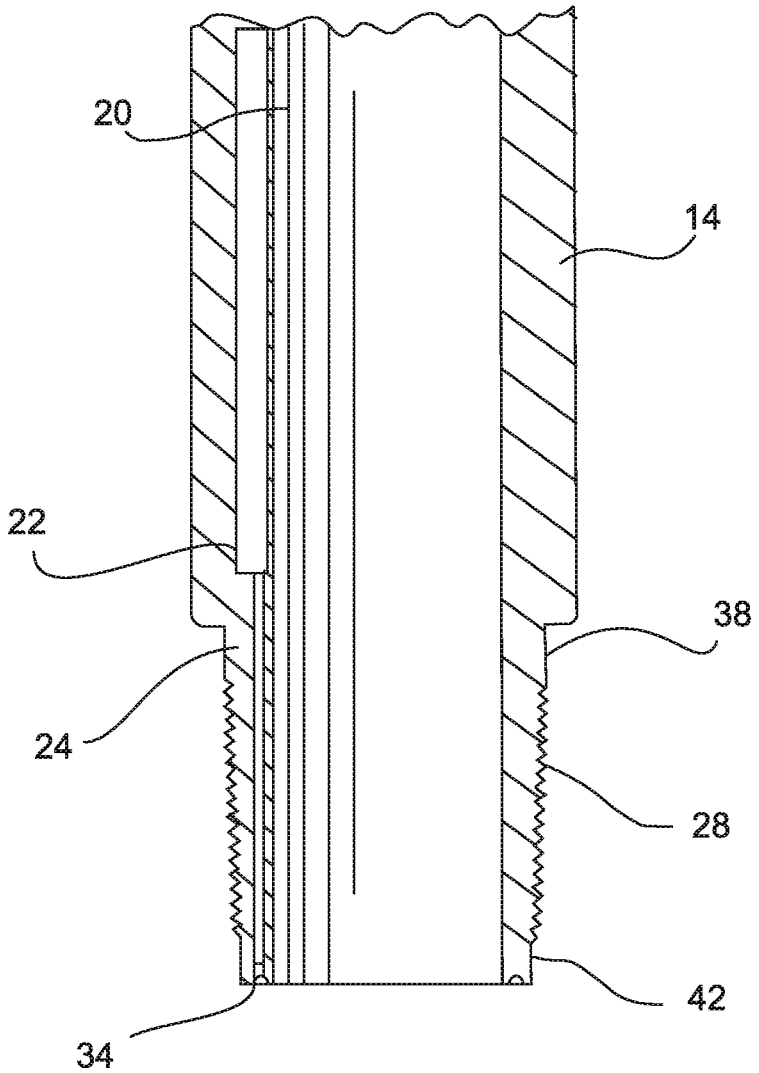
FIG. 3 depicts an exemplary embodiment of a pin end of the segment of FIG. 1.

Referring to FIGS. 2 and 3, the segment 14 includes at least one transmission device 34 (also referred to as a "coupler" herein) disposed therein and located at the pin end 24 and/or the box end 26. The transmission device 34 is configured to provide communication of at least one of data and power between adjacent segments 14 when the pin end 24 and the box end 26 are engaged. The transmission device 34 may be of any suitable type, such as an inductive coil, capacitive or direct electrical contacts, resonant coupler, or an optical connection ring. The coupler may be disposed at the inner or outer shoulder or in between. It shall be understood that the transmission device 34 could also be included in a repeater element disposed between adjacent segments 14 (e.g., within the box end). In such a case, the data/power is transmitted from the transmission device 34 in one segment 14, into the repeater. The signal may then be passed "as is," amplified, and/or modified in the repeater and provided to the adjacent segment 14.

Regardless of the configuration, it shall be understood that each transmission device 34 can be connected to one or more transmission lines 22. Embodiments disclosed herein are directed to how such transmission lines 22 can be formed. In particular, disclosed herein are transmissions lines that are formed such that including a transmission cable protected within a wire channel in a fixed manner.

Figure 4:
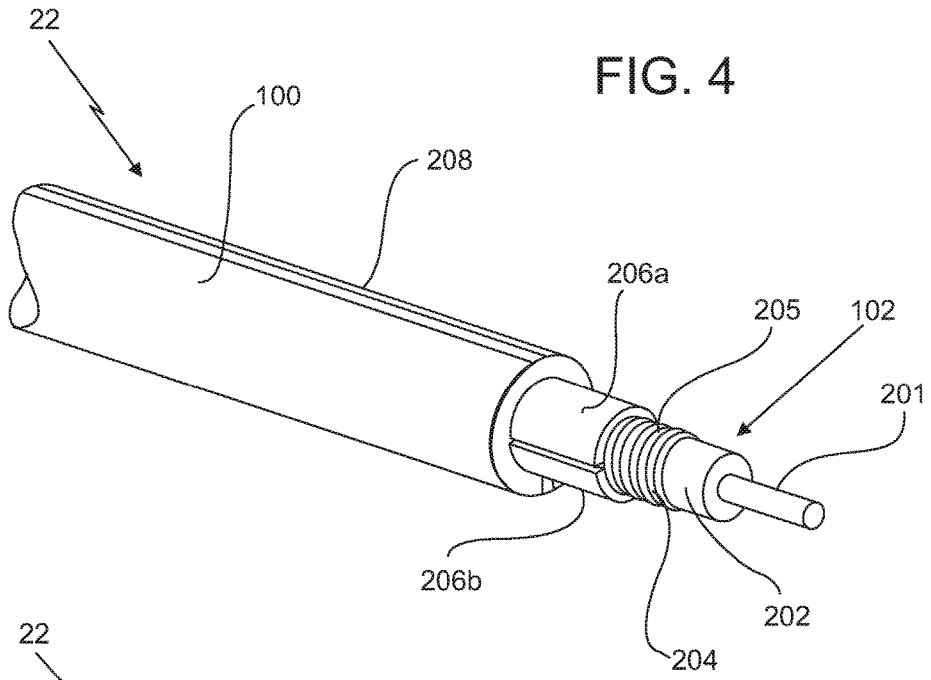
FIG. 4 shows a perspective view of a transmission cable according to one embodiment.

Turning now to FIG. 4, an example of a transmission line 22 that includes a transmission cable 102 disposed within a wire channel. The wire channel 100 can be formed of steel or a steel alloy in one embodiment. Of course, other materials could be used to form the wire channel 100. The wire channel 100 can be electrically coupled to or electrically isolated from the transmission line 102.

The transmission cable 102 illustrated in the FIG. 4 is a coaxial cable. Of course, other types of wires/cable could form the transmission cable 102. For example, the transmission cable 102 could be formed as a twisted pair.

In the illustrated embodiment, the transmission cable 102 is shown as a coaxial cable that includes an inner conductor 201 surrounded by an insulating layer such as dielectric layer 202. It should be understood that the wire inner conductor 201 could be a twisted pair or an individual wire that is surrounded by an insulating layer.

The inner conductor 201 may be formed of a solid or braided metallic wire. The insulating layer, for example dielectric layer 202, surrounds the inner conductor 201 for most of the length of the inner conductor 201. The illustrated transmission cable 102 can include a shield layer 204 that surrounds the dielectric layer 202. The shield layer 204 can be formed of a highly conductive material such as copper in one embodiment and can be a braided or solid layer of material.

In one embodiment, the shield layer 204 may be in direct contact with the wire channel 100. In the illustrated embodiment, the shield layer 203 may be physically separated from the wire channel 100 by, for example, an insulating layer. Of course, in such a configuration, the wire channel 100 and the shield layer 203 may be electrically coupled to one another by other means.

The combination of the dielectric layer 202 and the inner conductor 201 can be formed in any known manner. In one embodiment, the combination is formed such that the dielectric layer 202 and the inner conductor 201 are tightly bound.

Figure 6:
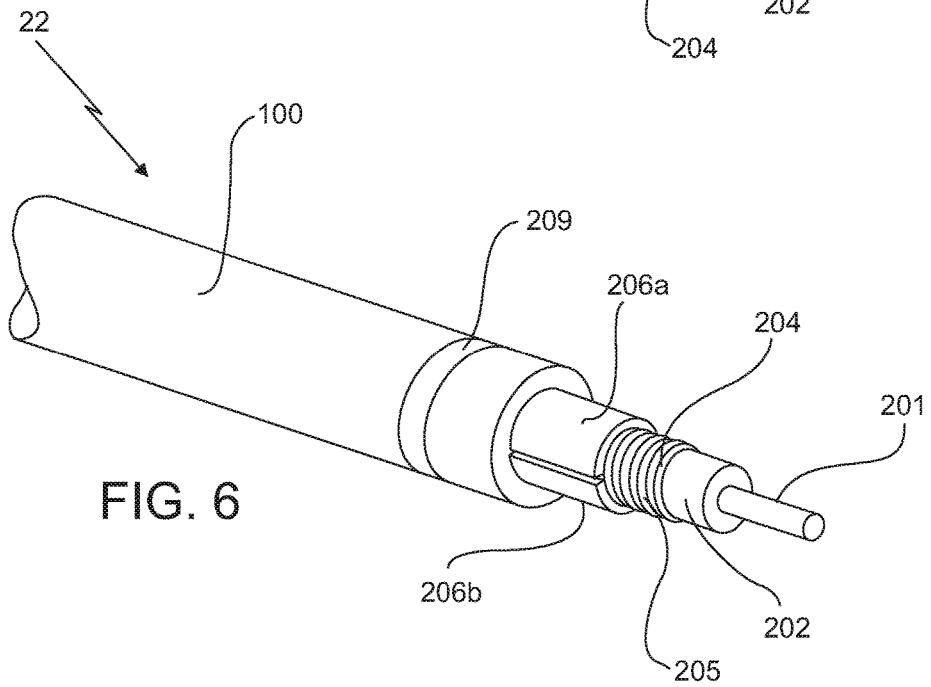
FIG. 6 shows a perspective view of a transmission cable according to another embodiment.
Figure 5:
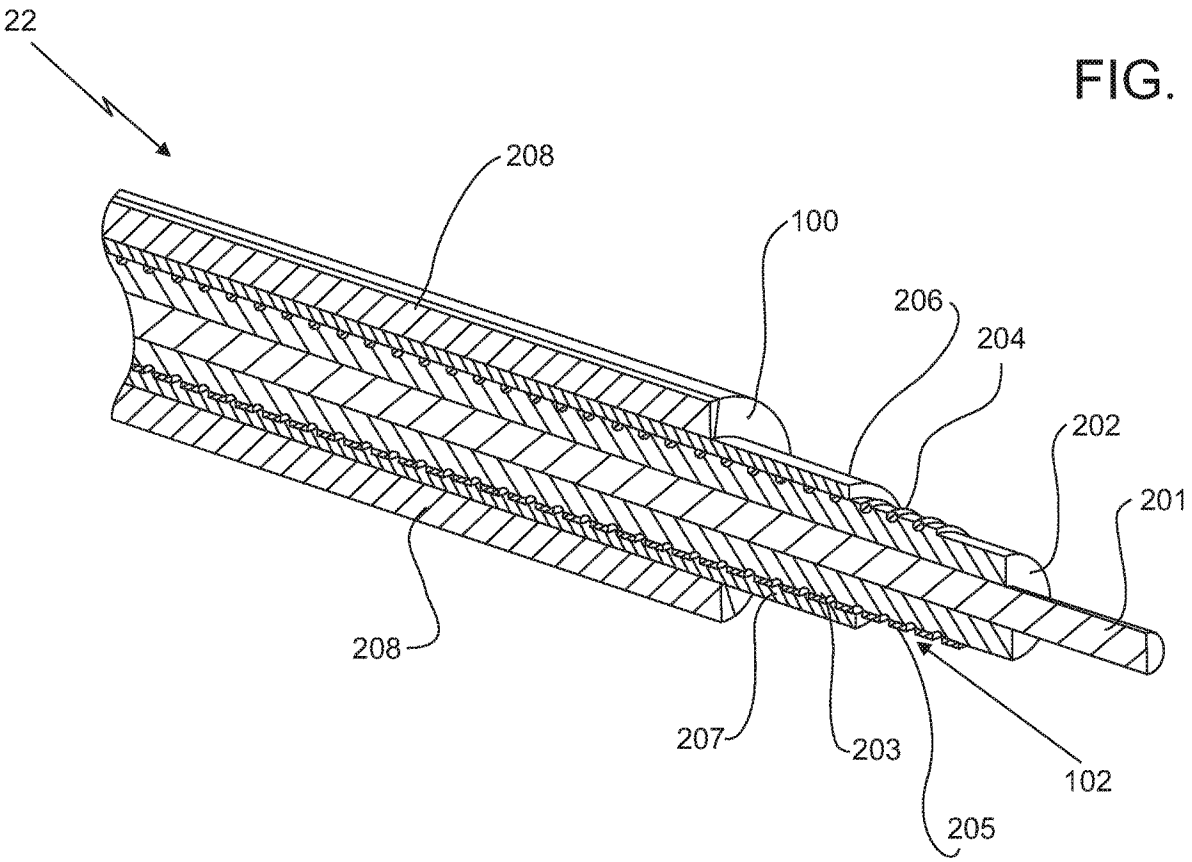
FIG. 5 shows a cut-away side view of the transmission cable of FIG. 4.

In the illustrated embodiment shown in FIG. 4-6, the shield layer 204 includes form closures 205 that mate with form closures that may be formed in the outer surface of the insulating layer 202. The threads 205 are on both the inner and outer sides of the shield layer 204 in the illustrated embodiment.

The form closures 205 on the outer side of the insulating layer 202 mate with form closures on an inner diameter of a fixation element 206. The illustrated fixation element 206 is shown as being formed of two half shells 206*a*, 206*b* but it shall be understood that these two half shells could be replaced by a tubular member including internal threads. In the above examples, it has been assumed that the fixation element 206 is in direct contact with the shield layer 204.

Figure 8:
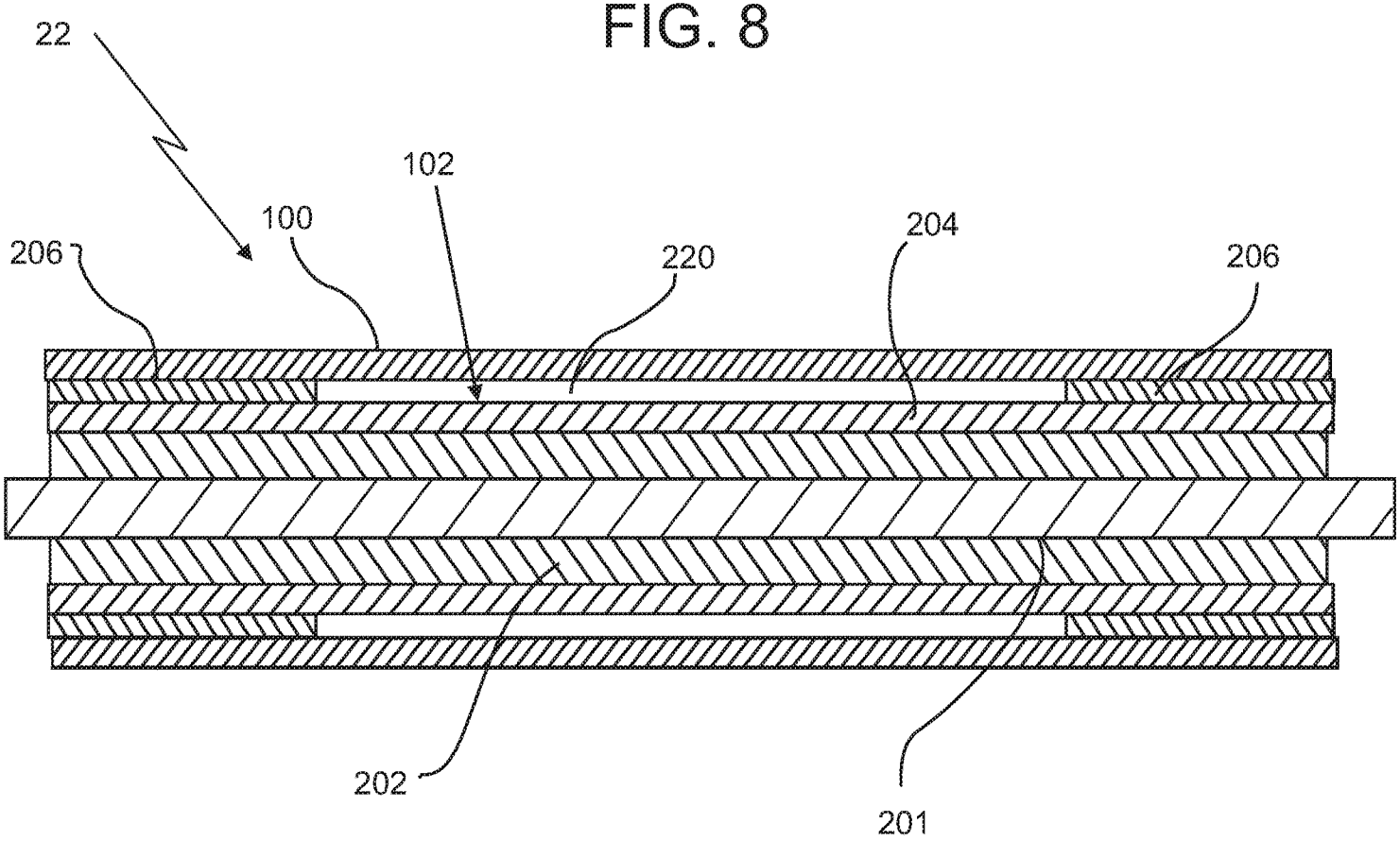
FIG. 8 shows a cut-away side view of a transmission cable according to one embodiment.

The fixation element 206 may only extend along the transmission line 22 at or near the ends of the transmission line 22 as is best shown in FIG. 8. The wire channel 100 is shown physically coupled to the fixation elements 206. The fixation elements 206 do not extend along the entire length of the transmission line 22 but only at or near the ends thereof. The fixation elements 206 can be either the threaded elements as described above but could be replaced, for example, by an adhesive or a fluid that includes expandable microspheres. Regardless of how formed, in one embodiment, a space 220 exists between fixation elements 206 disposed at either end of the transmission line 22. In one embodiment, the space 220 is filled with air. The space 220, or portions thereof, could be filled by any type of element that keeps the transmission line from contacting the wire channel 100 and may include an adhesive in one embodiment.

Referring now again to FIGS. 4-6, a method of forming a transmission cable 102 is described. A transmission cable 102 is provided that includes an inner conductor 201 surrounded by insulating layer 202. The insulating layer 202 includes, in one embodiment, threads 203 formed on an outer diameter thereof. In this illustrated embodiment, the shield layer 204 includes threads 205 that mate with the threads 203 of the insulating layer 202. In one embodiment, the threads 203 are formed and then the shield layer 204 is added in a manner such that threads 205 are formed that match threads 203. In another embodiment, the shield layer 204 is added to an insulating layer 202 that has a smooth outer surface and threads 203/205 are then impressed on the shield 204 and insulating layers 202. It shall be understood that the threads in the shield layer 204/insulating layer 202 could be formed by the fixation element 206 in one embodiment.

Regardless of how formed, the transmission line 22 is then inserted into the wire channel 100. Next, a fixation element 206 is inserted between the wire channel 100 and the transmission cable 102. In one embodiment, the fixation element 206 includes internal threads 207 that mate with the threads 205 of the shield layer 204. In such an embodiment, the fixation element 206 is threaded into position. Once positioned, the wire channel 100 is fixedly bonded to the fixation element 206 by either axial welds 208 (FIGS. 4 and 5) or one or more radial welds 209 (FIG. 6).

In one embodiment, an insulating layer could be disposed between the shield layer 204 and the fixation element 206. This layer may electrically insulate the shield layer 204 from the fixation element 206 and, thereby, electrically separate the shield layer 204 from the wire channel 100. In such a case, it shall be understood that the internal threads 207 could still mate with the threads 205 of the shield layer 204, but through the insulating layer.

Figure 7A:
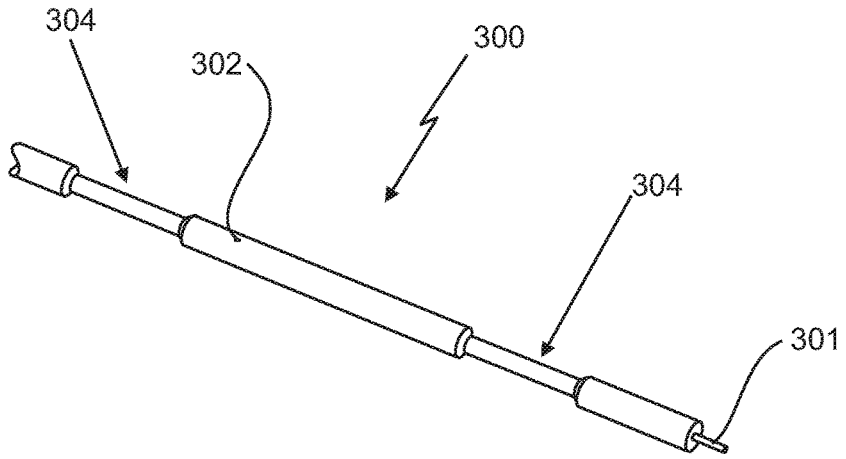
FIGS. 7*a* and 7*b* show perspective views of portions of a transmission cable according to another embodiment.
Figure 7B:
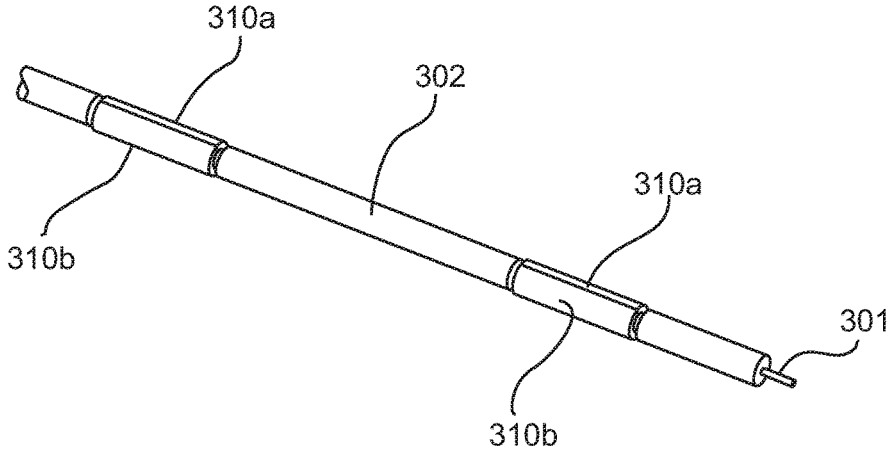

An alternative embodiment of a portion of a transmission cable 300 is shown in FIGS. 7*a* and 7*b*. The transmission line 300 in this embodiment is shown as a portion of a coaxial cable that includes an inner conductor 301 surrounded by an insulating layer such as dielectric layer 302. It should be understood that the inner conductor 301 could be a twisted pair or an individual wire that is surrounded by an insulating layer.

The inner conductor 301 may be formed of a solid or braided metallic wire. The insulating layer, for example dielectric layer 302, surrounds the inner conductor 301 for most of the length of the inner conductor 301. The illustrated transmission cable 300 can include a shield layer (not shown) that surrounds the dielectric layer 302. The shield layer can be formed of a highly conductive material such as copper in one embodiment and can be a braided or solid layer of material.

As illustrated, the insulating layer 302 includes multiple recesses 304 formed on its outer diameter. One or more fixation elements 310 can be attached to the insulating layer 302 in the recesses 304 such that the outer diameter of the fixation elements 310 is the same or slightly larger than the outer diameter of the insulating layer 302 in regions that do not include the recesses 304. Of course, if a shield layer is present, the outer diameter of the fixation elements 310 may be the same or slightly larger than the outer diameter of the shield layer in regions that do not include the recesses 304. The illustrated fixation elements 310 are shown as being formed of two half shells 310*a*, 310*b* but it shall be understood that these two half shells could be replaced by a fully tubular member or slotted tubular member. The assembly that includes the fixation elements 310 as shown in FIG. 7*b* can be inserted into a wire channel to form a transmission cable. In this case, the wire channel may be welded to the fixation elements.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wired pipe system comprising:

a wired pipe segment having a first end and a second end;

a first coupler in the first end and a second coupler in the second end; and a transmission line disposed in the wired pipe segment between the first and second ends, the transmission line comprising:

a transmission cable that includes:

an inner conductor; and an insulating material surrounding and contacting the inner conductor, wherein an outer surface of the insulating layer is threaded, and a wire channel surrounding the insulating material and the inner conductor for at least a portion of a length of the transmission cable;

wherein the wire channel and the insulating material are mated to each other by the threaded layer of the insulated material.

2. The wired pipe system of claim 1, wherein the threaded outer surface engages with threads included in the wire channel for at least a portion of a length of the wire channel.

3. The wired pipe system of claim 1, further comprising:

a fixation element disposed between the wire channel and the insulating material, the fixation element having a fixation element mating feature at the inner diameter of the fixation element that mates with the threaded layer of the insulating material.

4. The wired pipe system of claim 3, wherein the fixation element mating feature is threads.

5. The wired pipe system of claim 3, wherein the fixation element is fixedly attached to the wire channel by a weld.

6. The wired pipe system of claim 5, wherein the weld is either radially or axially disposed along an outer surface of the wire channel.

7. The wired pipe system of claim 1, further comprising:

a shield layer disposed between the insulating material and the wire channel for at least a portion of the length of the transmission cable.

8. The wired pipe system of claim 7, wherein the shield layer comprising a shield layer mating feature, wherein the shield layer mating feature is threads formed on the shield layer.

9. A wired pipe transmission line for transmitting electrical signals in a wired pipe system, the wired pipe transmission line comprising:

a transmission cable including:

an inner conductor;

an insulating material surrounding and contacting the inner conductor, the insulating material including a mating feature formed on an outer surface thereof; and a shield layer surrounding the insulating material and having a threaded inner that mates with the mating feature;

a wire channel surrounding the insulating material and the inner conductor for at least a portion of a length of the transmission cable; and a fixation element disposed between the shield layer and the wire channel that is fixedly attached to the wire channel, the fixation element including fixation element mating features formed on an inner portion that mate with shield layer threaded inner surface.

10. The wired pipe transmission line of claim 9, wherein the fixation element is fixedly attached to the wire channel by a weld.

11. A wired pipe transmission line for transmitting electrical signals in a wired pipe system, the wired pipe transmission line comprising:

a transmission cable including:

an inner conductor;

an insulating material surrounding and contacting the inner conductor, the insulating material having a threaded outer surface; and a shield layer surrounding the insulating material having shield layer mating features that mate with the threaded outer surface of the insulating layer;

a wire channel surrounding the insulating material and the inner conductor for at least a portion of a length of the transmission cable; and a fixation element disposed between the shield layer and the wire channel that is fixedly attached to the wire channel, the fixation element including fixation element mating features formed on an inner portion that mate with shield layer mating features.

12. The wired pipe transmission line of claim 11, wherein the shield layer mating features are threads.

13. The wired pipe transmission line of claim 11, wherein the fixation element is fixedly attached to the wire channel by a weld.

* * * * *